US011585180B2

(12) United States Patent
Camus et al.

(10) Patent No.: US 11,585,180 B2
(45) Date of Patent: Feb. 21, 2023

(54) SUBSEA WELL INTERVENTION METHOD

(71) Applicant: TOTAL SE, Courbevoie (FR)

(72) Inventors: Mathieu Camus, Pau (FR); Thibault Blanckaert, Pau (FR); Johnsen Malanda, Pau (FR)

(73) Assignee: TOTAL SE, Courbevoie (FR)

( * ) Notice: Subject to any disclaimer, the term of this patent is extended or adjusted under 35 U.S.C. 154(b) by 0 days.

(21) Appl. No.: 17/311,142

(22) PCT Filed: Dec. 5, 2019

(86) PCT No.: PCT/EP2019/083819
§ 371 (c)(1),
(2) Date: Jun. 4, 2021

(87) PCT Pub. No.: WO2020/115207
PCT Pub. Date: Jun. 11, 2020

(65) Prior Publication Data

US 2022/0025729 A1 Jan. 27, 2022

(30) Foreign Application Priority Data

Dec. 6, 2018 (EP) ..... 18306630

(51) Int. Cl.

| | |
|---|---|
| ***E21B 33/038*** | (2006.01) |
| ***E21B 47/117*** | (2012.01) |
| ***E21B 33/035*** | (2006.01) |
| ***E21B 41/00*** | (2006.01) |

(52) U.S. Cl.
CPC ..... *E21B 33/038* (2013.01); *E21B 33/0355* (2013.01); *E21B 41/0007* (2013.01); *E21B 47/117* (2020.05)

(58) Field of Classification Search
CPC .. E21B 33/038; E21B 33/0355; E21B 47/117; E21B 41/0007
See application file for complete search history.

(56) References Cited

U.S. PATENT DOCUMENTS

| | | | | |
|---|---|---|---|---|
| 4,601,608 | A | 7/1986 | Ahlstone | |
| 7,159,669 | B2 * | 1/2007 | Bourgoyne | E21B 21/001 166/85.4 |
| 7,487,836 | B2 | 2/2009 | Boyce et al. | |
| 8,781,743 | B2 * | 7/2014 | McKay | E21B 33/064 702/9 |

(Continued)

FOREIGN PATENT DOCUMENTS

| | | |
|---|---|---|
| WO | 2006/099316 A1 | 9/2006 |
| WO | 2011/100305 A1 | 8/2011 |

(Continued)

*Primary Examiner* — Aaron L Lembo
(74) *Attorney, Agent, or Firm* — Seed Intellectual Property Law Group LLP

(57) ABSTRACT

A subsea well intervention method implemented on a well (200) from a floating vessel (100), said floating vessel not comprising a derrick, the method comprising a step of connecting a power line (207) directly between a remotely operated vehicle (206) and the blowout preventer module (202) for powering the blowout preventer module, the remotely operated vehicle (206) being connected to a control unit (107) located on the floating vessel via a remotely operated vehicle umbilical (106).

14 Claims, 13 Drawing Sheets

(56) References Cited

U.S. PATENT DOCUMENTS

| | | | | |
|---|---|---|---|---|
| 9,004,175 | B2 * | 4/2015 | Abel | E21B 33/035 166/344 |
| 9,010,431 | B2 | 4/2015 | Billington et al. | |
| 10,048,673 | B2 * | 8/2018 | Holmes | E21B 34/16 |
| 10,767,438 | B2 * | 9/2020 | Papadimitriou | E21B 33/064 |
| 2010/0025044 | A1 | 2/2010 | McKay et al. | |
| 2014/0048274 | A1 * | 2/2014 | Reynolds | E21B 33/038 166/338 |
| 2015/0176346 | A1 | 6/2015 | Morris et al. | |
| 2017/0260835 | A1 | 9/2017 | Crawford et al. | |
| 2019/0186221 | A1 * | 6/2019 | Dagestad | E21B 19/002 |

FOREIGN PATENT DOCUMENTS

| | | | |
|---|---|---|---|
| WO | 2012/007407 | A2 | 1/2012 |
| WO | 2013/101601 | A1 | 7/2013 |
| WO | 2018/097986 | A1 | 5/2018 |

* cited by examiner

S09

S10

S15

300

S16

SUBSEA WELL INTERVENTION METHOD

FIELD OF THE INVENTION

The present invention concerns a subsea well intervention method implemented on a subsea well from a floating vessel, wherein the subsea vessel is a small vessel not comprising a derrick or rig.

BACKGROUND OF THE INVENTION

During production phase, subsea wells require maintenance and/or remediation to improve flow or production of hydrocarbon fluid. The intervention process often needs to lower at least one specialized tool inside the well by means of a wire line or cable.

The tool is lowered into the well through a lubricator module, a blowout preventer module, and the subsea tree.

The subsea tree is a system located on the top of the well at the sea floor, i.e. at the wellhead, such system comprising a plurality of valves for controlling the well flow during production phase.

The blowout preventer module, commonly named as a BOP, is a security system comprising valves that are able to seal the well in case of emergency and to avoid leak of hydrocarbon fluid in the environment.

Such blowout preventer module can be installed above the subsea tree via a running adapter module that is designed to adapt the blowout preventer module mechanical interface to the subsea tree mechanical interface. Thanks to this running adapter module a blowout preventer module from a first supplier can be connected to a subsea tree from a second supplier. Additionally, such running adapter module helps the automatic secured connection of said blowout preventer module on top of subsea tree in vertical direction at the deep-sea floor via a remotely operated vehicle.

The lubricator module is a system located on the top of the blowout preventer module that provides sealing of the wire line and that keeps the fluids pressure inside the well during the use and displacement of the tool inside the well.

Usually, such tool intervention uses a workover string connected above the blowout preventer module to run down the blowout preventer module inside sea water down to the subsea tree. However, such system and method require a large floating vessel having a derrick and a storing of a lot of riser for assembling and deploying the workover string inside sea.

Another method is to use a subsea lubricator to eliminate the use of a workover riser. The blowout preventer module and the lubricator module are run down to the subsea tree by a cable line that is deployed via a crane and a winch, located on the floating vessel. A remotely operated vehicle helps the guiding and the secured connection of this subsystem above the subsea tree. A control umbilical is also installed between the floating vessel and the subsystem of the blowout preventer module and the lubricator module for providing power fluids to the blowout preventer module and to the lubricator module. For example, it provides the fluids that circulates in the lubricator module, and the power to actuate various valves inside this subsystem.

The patent document U.S. Pat. No. 7,487,836 B2 shows such riserless modular subsea well intervention, method and apparatus using a subsea lubricator assembly and a blowout preventer module. Such system is operated via a control umbilical running in parallel to the wire line up to the floating vessel, and connected to a fail safe disconnect assembly near the blowout preventer module for rapidly and securely disconnect said control umbilical in case of emergency caused by drive-off condition that force the floating vessel to move away from the position over the well without recovering various equipments attached to the subsea tree.

However, such system and method are still complex, and this needs a lot of time to be deployed and to be used.

OBJECTS AND SUMMARY OF THE INVENTION

One object of the present invention is to provide a more optimised subsea intervention method for a subsea well. This method uses a floating vessel not comprising a derrick and is therefore a rigless and derrickless intervention method.

The method comprises the following steps:

- connecting a blowout preventer module onto a subsea tree,
- connecting a lubricator module onto the blowout preventer module,
- connecting a power line directly between a remotely operated vehicle and the blowout preventer module for powering the blowout preventer module, the remotely operated vehicle being connected to a control unit located on the floating vessel via a remotely operated vehicle umbilical,
- running down in water an assembly of a tool and a pressure control head, said tool being suspended by a wire line from a first crane of a floating vessel,
- running the tool inside the lubricator module,
- connecting the pressure control head onto the lubricator module,
- operating a test procedure of at least one of the pressure control head, the lubricator module and the blowout preventer module by the control unit and via the remotely operated vehicle and its power line,
- opening valves of the blowout preventer module, and
- running the tool down inside the well.

Thanks to the above method, the lubricator module and the blowout preventer module are powered directly from a remotely operated vehicle.

There is no more need of a control umbilical for the subsea equipments, said control umbilical being dependent from the lubricator and blowout preventer module providers.

Moreover, the floating vessel has no need of a derrick, and it has no additional control umbilical reel as is uses the remotely operated vehicle features. There is no need of riser on the floating vessel as the tool is ran directly by a wire line.

Therefore, the floating vessel equipments are less numerous, simpler, more easily used, and more independent from the various suppliers of subsea equipments.

The method is more universal in view of the plurality of equipments suppliers installed on the subsea well. And, the control of these equipments are more independent one to another.

Then, the subsea well intervention method is implemented more quickly and is less expensive.

In various embodiments of the method, one and/or other of the following features may optionally be implemented.

According to an aspect of the method, the test procedure is at least a pressure test to ensure sealing performance of a main conduit inside the blowout preventer module, the lubricator module and the pressure control head, before opening valves of the blowout preventer module that open said main conduit to the well.

According to an aspect of the method, the test procedure comprises:

operating a first test consisting of testing the blowout preventer module via the remotely operated vehicle, after connecting the blowout preventer module onto a subsea tree, operating a second test of the lubricator module and blowout preventer module via the remotely operated vehicle, after connecting the lubricator module onto the blowout preventer module, and operating a third test of the the pressure control head, the lubricator module and the blowout preventer module, after connecting the pressure control head onto the lubricator module, the tool being inside a main conduit inside the lubricator module.

According to an aspect of the method, before running down in water the assembly, the method comprises preparing the assembly on the floating vessel by:

connecting the tool to the wire line from the first crane, vertically, above the floating vessel deck, the pressure control head being above the tool and the wire line passing through the pressure control head toward the tool, and using the first crane to move the assembly above the sea for being able to run down in water said assembly.

According to an aspect of the method, before running down in water the assembly, the method comprises preparing the assembly on the floating vessel by:

enclosing the assembly inside a cage to maintain the assembly steady positioned inside said cage, said cage being located horizontally on the floating vessel deck, connecting the tool to the wire line from the first crane, the wire line passing through the pressure control head toward the tool, tilting the cage enclosing the assembly into a vertical direction, and moving the assembly above the sea for being able to run down in water said assembly.

According to an aspect of the method, the power line comprises a hydraulic line and an electric line.

According to an aspect of the method, the control unit communicates with the remotely operated vehicle via a physical link or via a wireless link.

According to an aspect of the method, the wireless link is an acoustic link.

Another object of the present invention is to provide a more optimised subsea intervention method for a subsea well. This method uses a floating vessel not comprising a derrick and is therefore a rigless and derrickless intervention method.

The method comprises the following steps:

connecting a blowout preventer module onto a subsea tree, connecting a power line directly between a remotely operated vehicle and the blowout preventer module for powering the blowout preventer module, the remotely operated vehicle being connected to a control unit located on the floating vessel via a remotely operated vehicle umbilical, running down in water an assembly of a lubricator module, a pressure control head and a tool, the pressure control head being connected to the lubricator module, the tool being inside the lubricator module and being suspended by a wire line from a first crane of the floating vessel, connecting the lubricator module of the assembly onto the blowout preventer module, the lubricator module including the tool, operating a test procedure of at least one of the pressure control head, the lubricator module and the blowout preventer module by the control unit and via the remotely operated vehicle and its power line, opening valves of the blowout preventer module, and running the tool down inside the well.

In various embodiments of the method, one and/or other of the following features may optionally be implemented.

According to an aspect of the method, the test procedure is a pressure test to ensure sealing performance of a main conduit inside the blowout preventer module, the lubricator module and the pressure control head, the tool being inside the main conduit in the lubricator module, and said pressure test being performed before opening valves of the blowout preventer module that open said main conduit to the well.

According to an aspect of the method, before running down in water the assembly, the method comprises preparing the assembly on the floating vessel by:

enclosing the assembly inside a cage to maintain the assembly steady positioned inside said cage, said cage being located horizontally on the floating vessel deck, connecting the tool to the wire line from the first crane, the wire line passing through the pressure control head toward the tool, tilting the cage enclosing the assembly into a vertical direction, and moving the assembly above the sea for being able to run down in water said assembly.

According to an aspect of the method, the power line comprises a hydraulic line and an electric line.

According to an aspect of the method, the control unit communicates with the remotely operated vehicle via a physical link or via a wireless link.

According to an aspect of the method, the wireless link is an acoustic link.

BRIEF DESCRIPTION OF THE DRAWINGS

Other features and advantages of the invention will be apparent from the following detailed description of two of its embodiments given by way of non-limiting example, with reference to the accompanying drawings. In the drawings.

In the various figures, the same reference numbers indicate identical or similar elements.

MORE DETAILED DESCRIPTION

Figure 1:
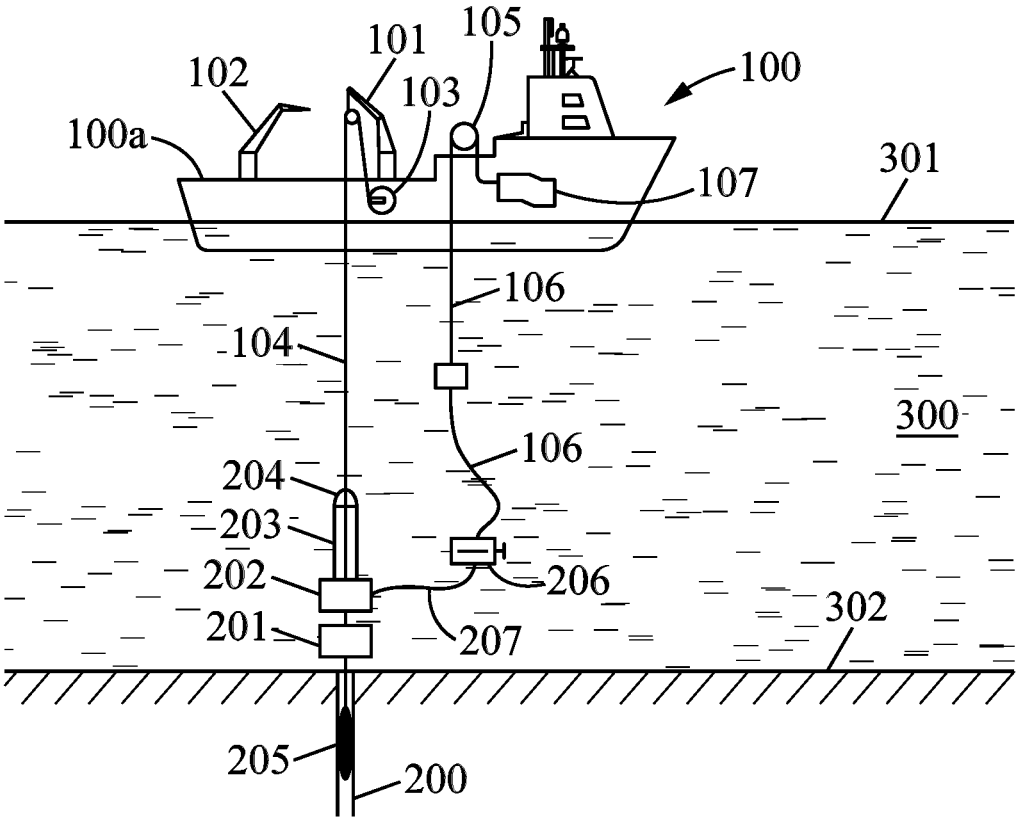
FIG. 1 is schematic view of the subsea well intervention system.

The FIG. 1 illustrates a subsea well intervention system used offshore in sea water 300, said system including:

a floating vessel 100 being at sea surface 301, a well 200 equipped with a subsea tree 201 above wellhead at sea floor 302.

A blowout preventer module (BOP) 202 is connected above the subsea tree 201. A lubricator 203 is connected above the blowout preventer module (BOP) 202. A pressure control head 204 substantially closes the top of the lubricator 203.

The blowout preventer module (BOP) 202 may correspond to an emergency disconnect package (EDP) and a low riser package (LRP). For example, the EDP may include security valves in case of any uncontrolled displacement of the floating vessel that may lead to its disconnection from the well. For example, the LRP may include valves or any other devices to isolate the well from environment, e.g. in case of excessive pressure inside the well.

The floating vessel 100 comprises:

- a first crane 101 and optionally a second crane 102,
- a first reel 103 for winding a wire line 104 (a cable), said wire line 104 being adapted to run down a tool 205 inside the well 200, the tool 205 being suspended at a lower end of said wire line 104,
- a second reel 105 for winding a remotely operated vehicle umbilical 106, said remotely operated vehicle umbilical 106 being connected between a control unit 107 located in the floating vessel 100 and a remotely operated vehicle (ROV) 206.

The tool 205 illustrated on FIG. 1 is the intervention tool that is intended to be introduced inside the well 200 for proceeding to an intervention inside said well. By "intervention", we mean any intervention that can be measurements and/or action to modify the well and/or to modify the flow of hydrocarbon fluid from the well. One goal of such intervention is to increase the flow of hydrocarbon fluid.

The object of present disclosure method is to introduce the tool 205 inside the well 200 in a safely way (the sealing must guaranteed without any risk of leak) and in a simple way (the method is less costly than previously known methods).

The subsea well intervention method according to present disclosure uses a floating vessel not comprising a derrick and is therefore a rigless and derrickless intervention method. This method generally comprises the following steps:

- connecting the blowout preventer module 201 onto the subsea tree 201,
- connecting the lubricator module 203 onto the blowout preventer module (BOP) 202,
- connecting a power line 207 directly between a remotely operated vehicle (ROV) 206 and the blowout preventer module (BOP) 202 for powering the blowout preventer module, the remotely operated vehicle (ROV) 206 being connected to a control unit 107 located on the floating vessel 100 via a remotely operated vehicle umbilical 106,
- running down in water an assembly of the tool 205 and a pressure control head 204, said tool 205 being suspended by a wire line 104 from a first crane 101 of the floating vessel 100,
- running the tool 205 inside the lubricator module 203,
- connecting the pressure control head 204 onto the lubricator module 203,
- operating a test procedure of at least one of the pressure control head 204, the lubricator module 203 and the blowout preventer module (BOP) 202 by the control unit 107 and via the remotely operated vehicle (ROV) 206 and its power line 207,
- opening valves of the blowout preventer module (BOP) 202, and
- running the tool 205 down inside the well 200.

The assembly is prepared above the floating vessel deck.

The test procedure is for example a pressure test to ensure sealing performance of a main conduit inside the blowout preventer module 202, the lubricator module 203 and the pressure control head 204.

The main conduit is a conduit that extends successively in various portions from the blowout preventer module 202, the lubricator module 203 and the pressure control head 204. This main conduit is aligned to the well inner tube.

The test procedure is therefore performed before opening valves of the blowout preventer module 202, said valves opening the main conduit to the well.

The power line 207 from ROV 206 comprises a hydraulic line. Preferably, the power line 207 comprises a hydraulic line and an electric line.

The power line 207 is fed with the ROV umbilical 106, and it may be controlled by the ROV 206 itself by information from the control unit 107.

FIGS. 2A to 2M illustrate a first embodiment of the above method, said embodiment being precisely detailed through all these figures. However, the skilled man understands that this is a detailed example, and that some of the disclosed steps can be optional and avoided.

Figure 2B:
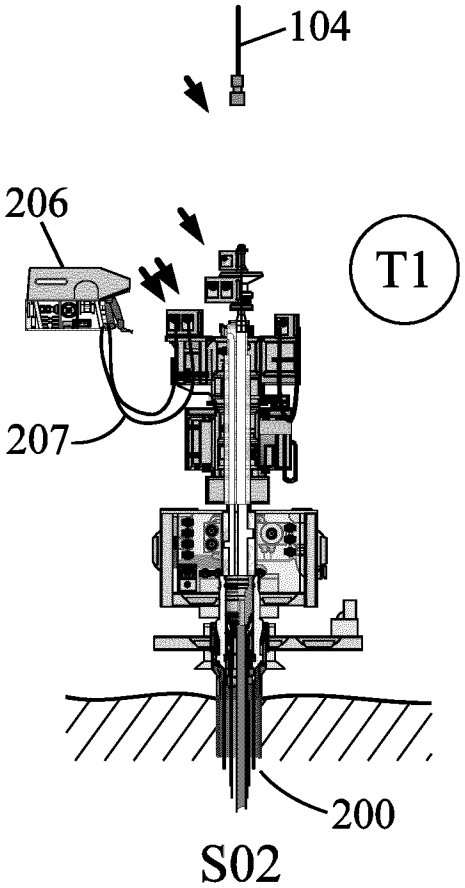
FIGS. 2A to 2Q are views of a first embodiment of the method, step by step.
Figure 2A:
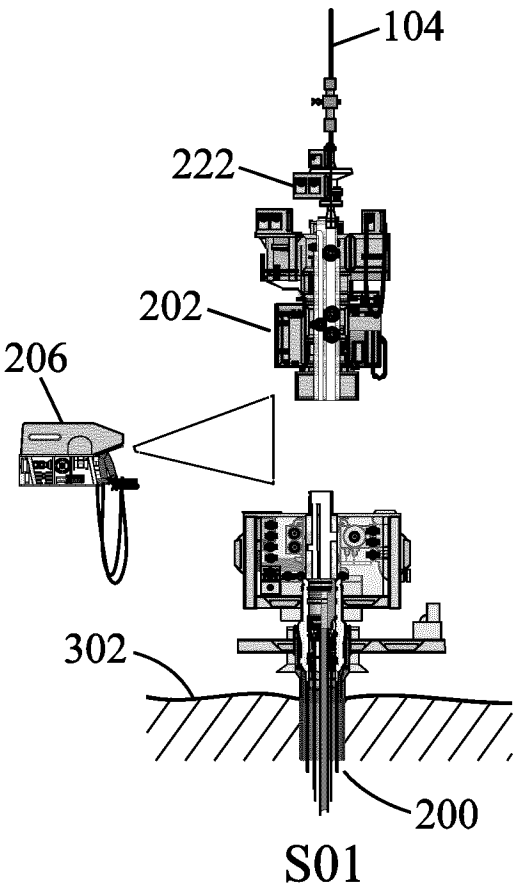

FIG. 2A illustrates a first step S01 in which a blowout preventer module 200 is ran down in sea water 300 by a wire line 104 from a first crane 101 of floating vessel 100. The valves of the blowout preventer module 200 are kept open for preventing locking of these valves while landing of the BOP module 202 on the subsea tree 201.

For smooth landing, the wire line 104 is equipped on the floating vessel with an active heave compensator, and the ROV 206 is communicating with the control unit 107 to send images of the upper area of the subsea tree 201 for guiding the running down and the landing of the BOP module 202 down to the subsea tree 201.

FIG. 2B illustrates a second step S02 in which the BOP module 202 landed and connected to the subsea tree 201.

The ROV 206 disconnects the wire line 104, and connects its power line 207 to the BOP module 202. The control unit 107 controls the locking of the subsea tree 201 via the ROV 206 and the BOP module 202.

Then, a first test T1 is operated, said first test T1 consisting of testing the BOP module 202 via the ROV 206. The first test T1 is a pressure test testing the sealing performance a main conduit between a swab valve in the subsea tree 201 and a lifting sub 222 connected above the BOP module 202.

The first test T1 should proves sealing performance of said main conduit by for example sustain a pressure level during a predetermined duration.

The ROV 206 then bleeds off the pressure at the lifting sub 222 by actuating a bleed off valve of said lifting sub 222.

Then, the ROV 206 disconnects its power line 207 from the BOP module 202.

Figure 2D:
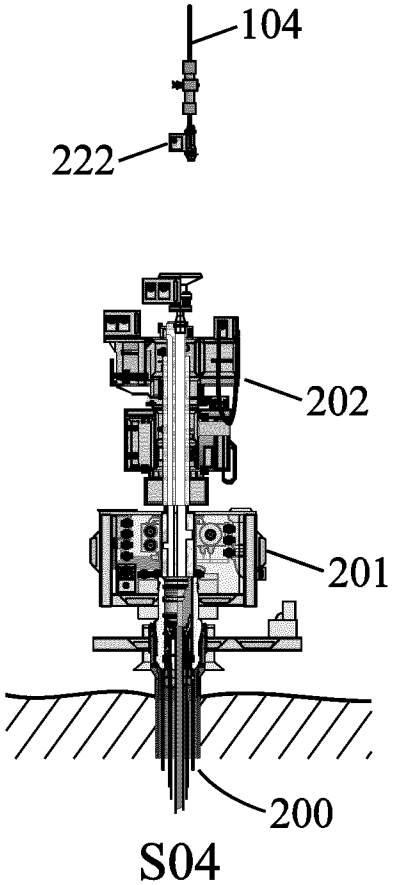
Figure 2C:
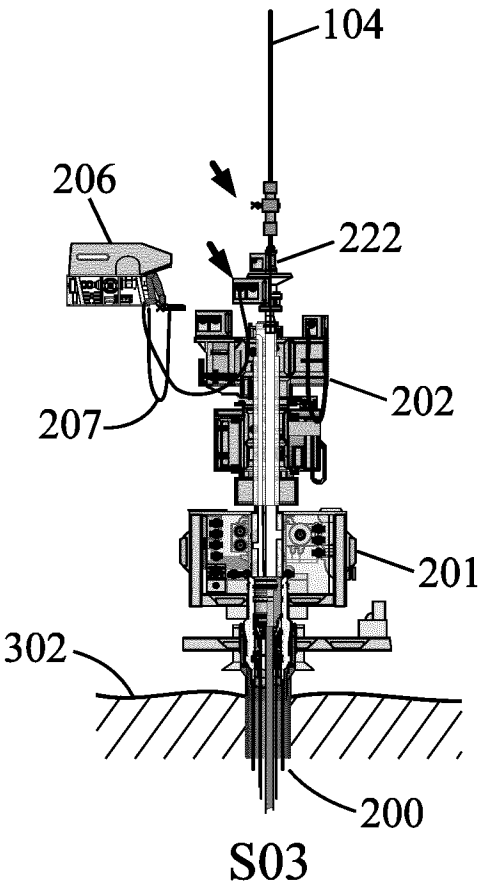

FIG. 2C illustrates a third step S03 in which the ROV 206 reconnects the wire line 104 to the lifting sub 222 above the BOP module 202. Then, the ROV unlocks the lifting sub 222 from the BOP module 202.

FIG. 2D illustrates a fourth step S04 in which the first crane 101 pulls the wire line 104 to pull out the lifting sub 222 from sea water 300.

Figure 2F:
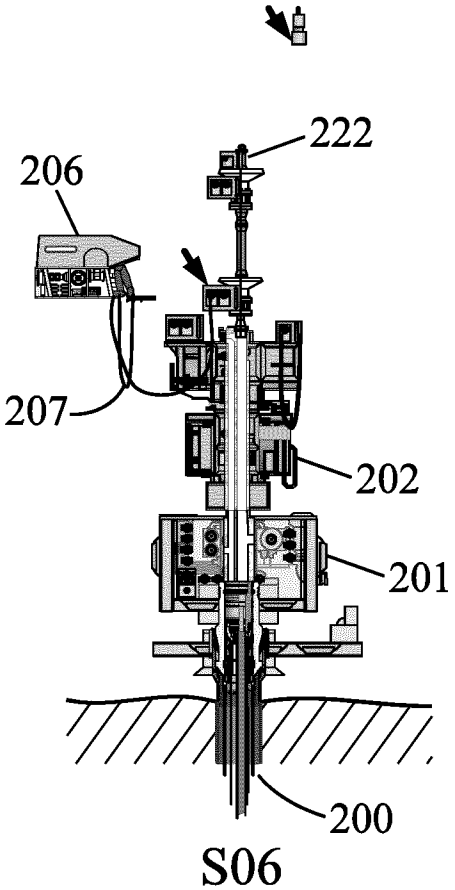
Figure 2E:
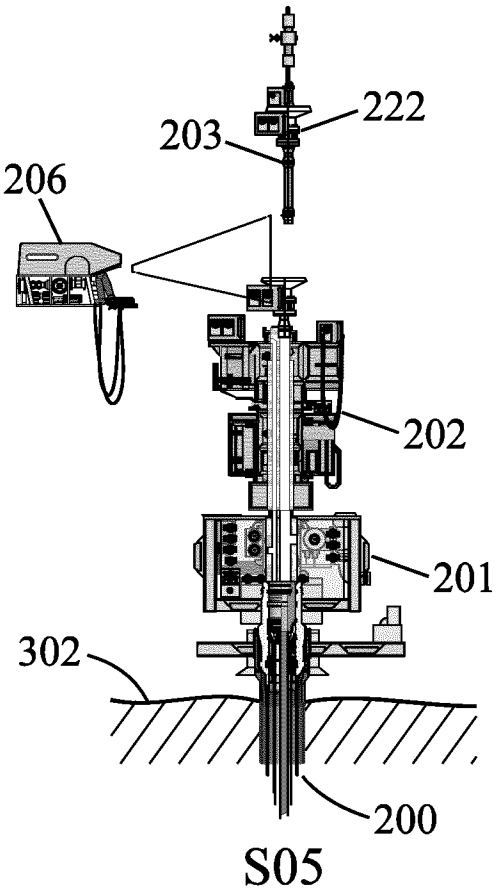

FIG. 2E illustrates a fifth step S05 in which the first crane 101 runs down the lubricator module 203 to the top of the BOP module 202. The ROV 206 guides the final approach before the landing of the lubricator module 203 above the BOP module 202.

FIG. 2F illustrates a sixth step S06 in which the ROV 206 disconnects the wire line 104 from the lubricator module 203, and locks the lubricator module 203 on the BOP module 202. Then, the lubricator module 203 is connected to the BOP module 202.

Figure 2H:
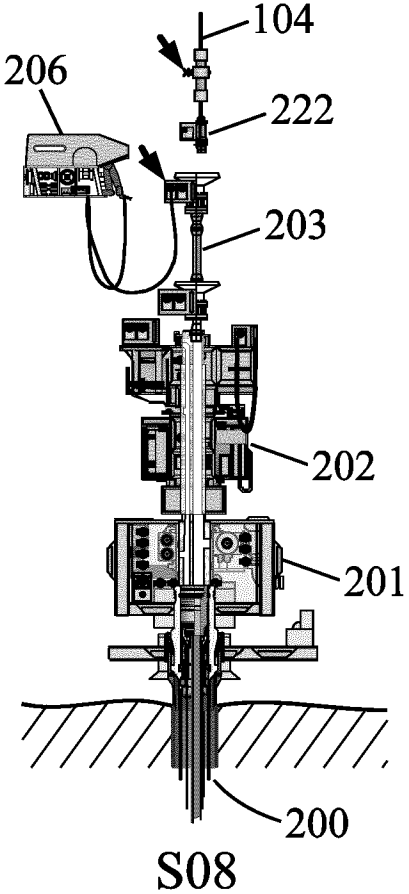
Figure 2G:
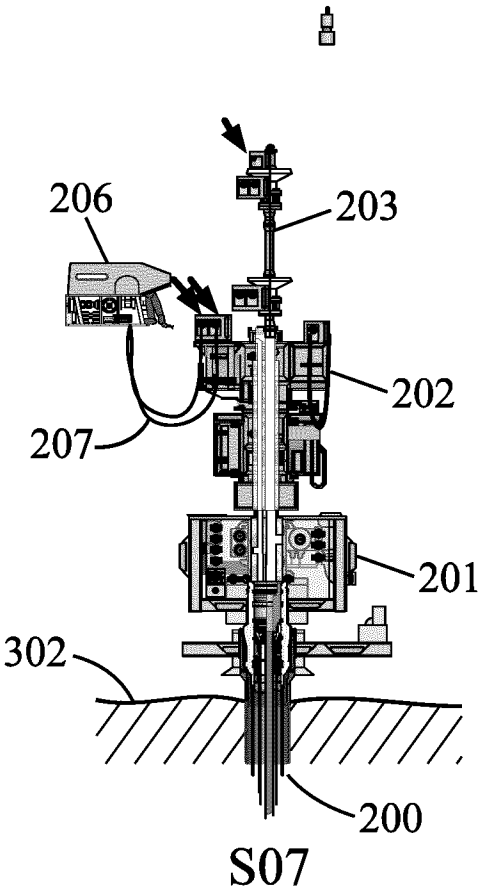

FIG. 2G illustrates a seventh step S07 in which the ROV 206 connects its power line 207 to the BOP module 202. Then, the control unit 107 is able to control the BOP module 202 via the ROV 206.

Then, a second test T2 is operated, said second test T2 consisting of testing the BOP module 202 and the lubricator module 203 via the ROV 206. The second test T2 is a pressure test testing the sealing performance a main conduit between a swab valve in the subsea tree 201 and the lubricator module 203 connected above the BOP module 202.

Then, if the second test T2 proves sealing performance, the ROV 206 disconnects its power line 207 from the BOP module 202.

The ROV 206 then bleeds off the pressure at the lifting sub 222 by actuating a bleed off valve of said lifting sub 222.

FIG. 2H illustrates a eighth step S08 in which the ROV 206 reconnects the wire line 104 to the lifting sub 222 above the lubricator module 203. Then, the ROV unlocks the lifting sub 222 from the lubricator module 202.

Then, the first crane 101 pulls the wire line 104 to pull out the lifting sub 222 from sea water 300.

Figure 2I:
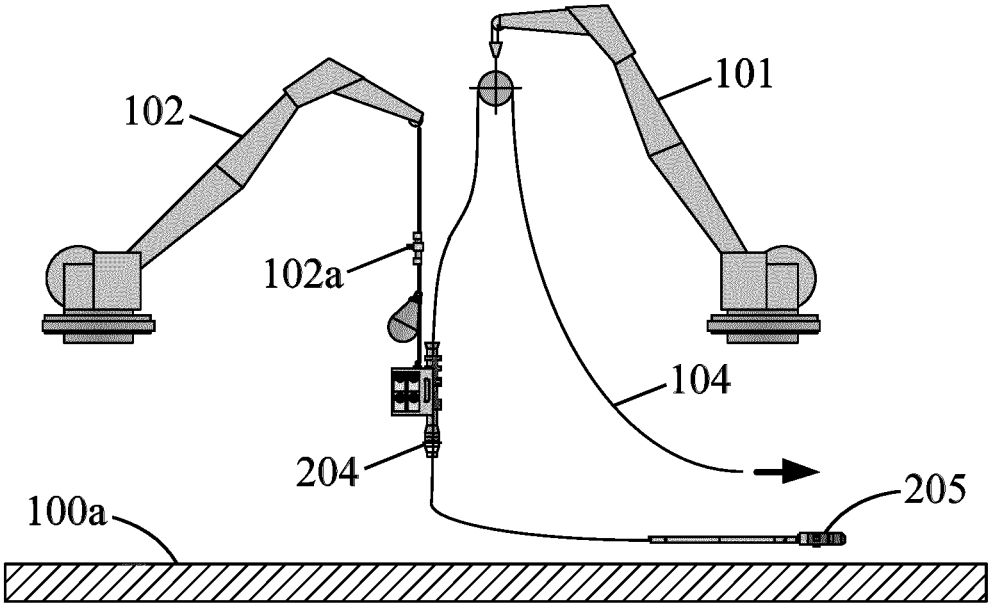

FIG. 2I illustrates a ninth step S09 in which the assembly of the tool 205 and the pressure control head 204 are prepared on the floating vessel deck by at least one crane (the first crane 101). In the example of FIGS. 2I to 2N, the method uses two cranes, the first crane 101 to handle the assembly, and a second crane 102 to control the displacements of assembly above the floating vessel deck.

During this step S09:

- a second crane 102 maintains the pressure control head 204 vertically by a second wire line 102*a*, and then
- the wire line 104 is passed through a sheave 101*a* of first crane 101 and is passed through the pressure control head 204, towards the 205 landing on the floating vessel deck.

Figure 2J:
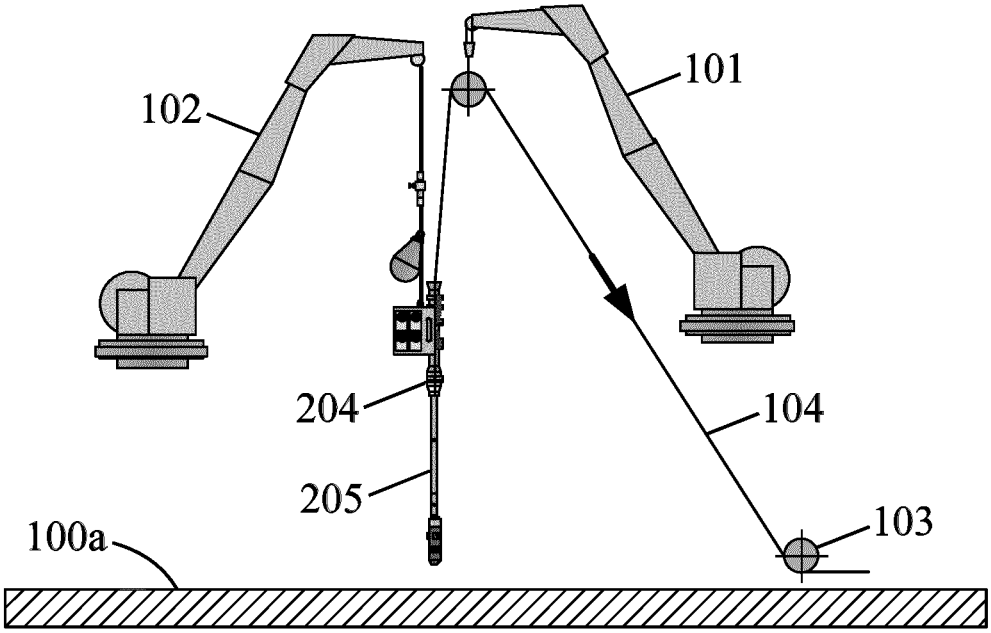

FIG. 2J illustrates a tenth step S10 in which the first reel 103 is actuated to pull the wire line to hang vertically the tool 205 just under the pressure control head 204, and then engaged partially inside the pressure control head 204 via its lower end.

Figure 2K:
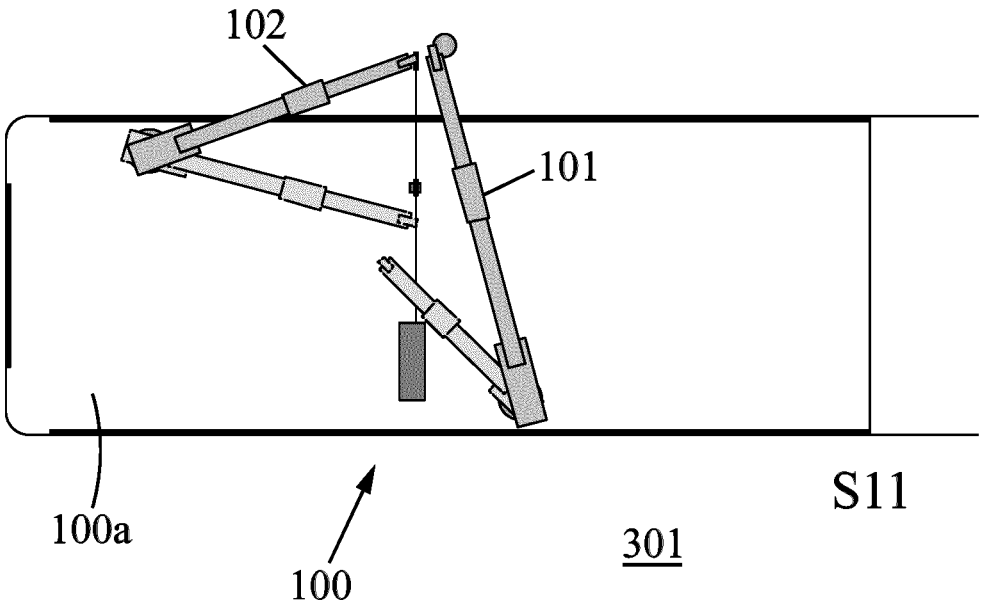

FIG. 2K illustrates an eleventh step S11 in which the first crane 101, the second crane 102 are rotated and their wire lines are actuated for moving the assembly from an area above the floating vessel deck 100*a* to another area above the sea surface 301.

The second area may be overboard of the floating vessel deck 101*a* or over a moonpool going through the floating vessel.

Figure 2L:
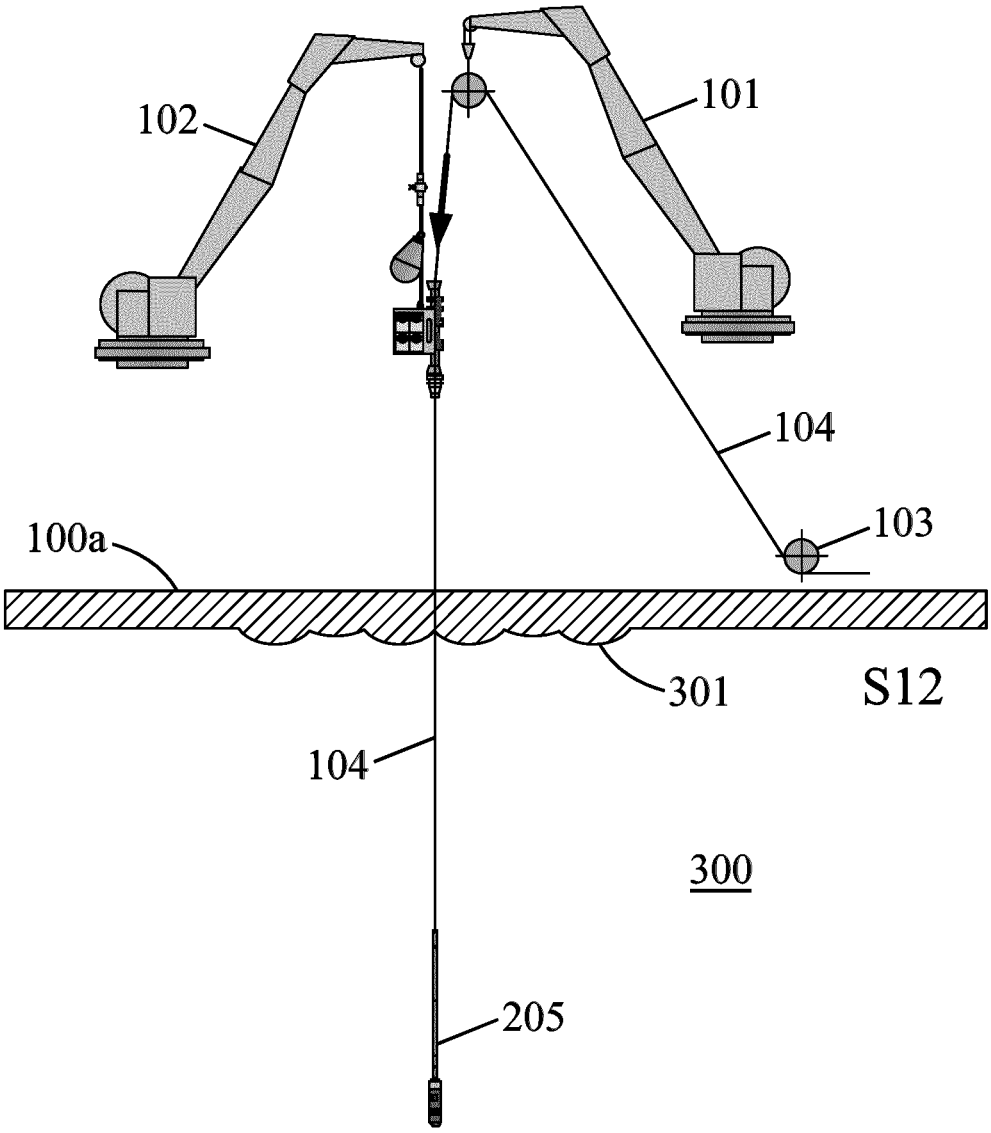

FIG. 2L illustrates a twelfth step S12 in which the wire line 104 is released by the first reel 103 to lower the tool 205 bellow the sea surface 301, while the pressure control head 204 is kept by the second crane 102 above the floating vessel deck 100*a*.

Figure 2M:
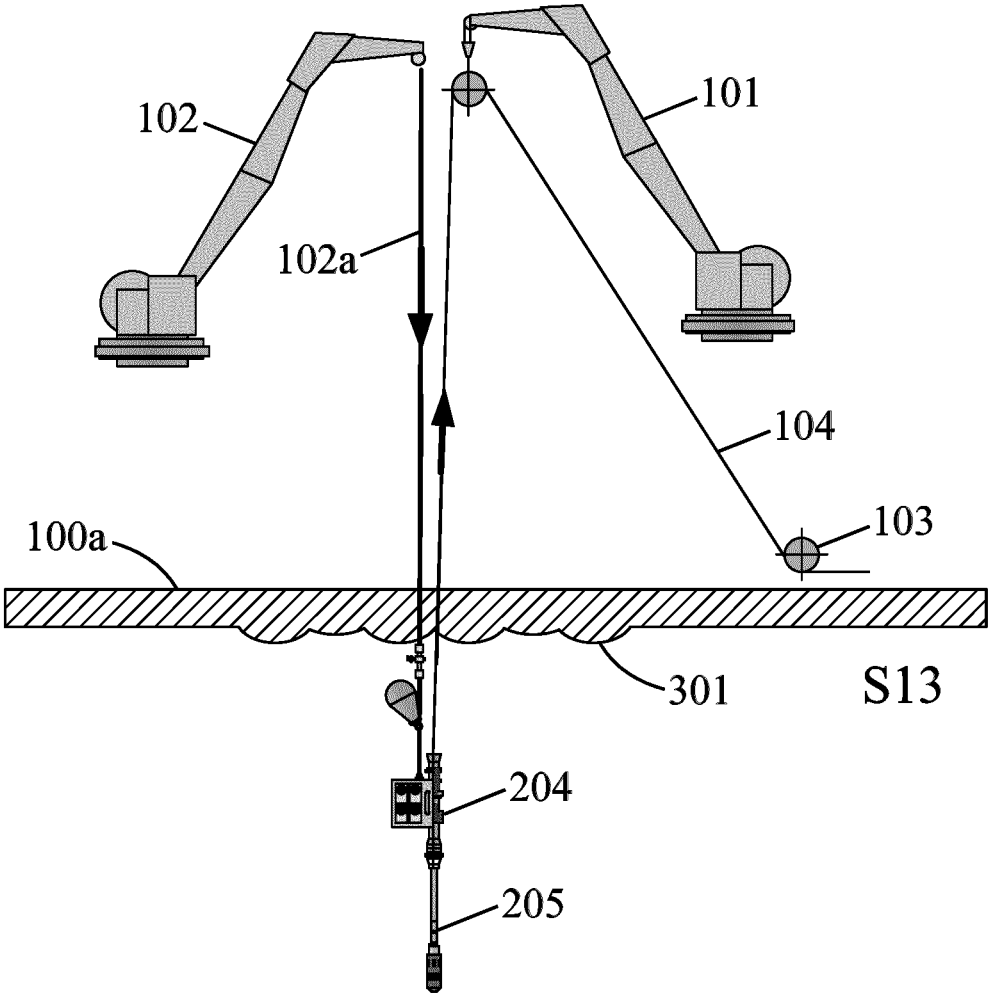

FIG. 2M illustrates a thirteenth step S13 in which the second crane 102 lower the pressure control head 204 bellow the sea surface 301 again towards the tool 205.

At this step, the assembly of the pressure control head 204 and the tool 205 are for example located at a sea depth of approximately 30 meters below sea surface 301.

Figure 2N:
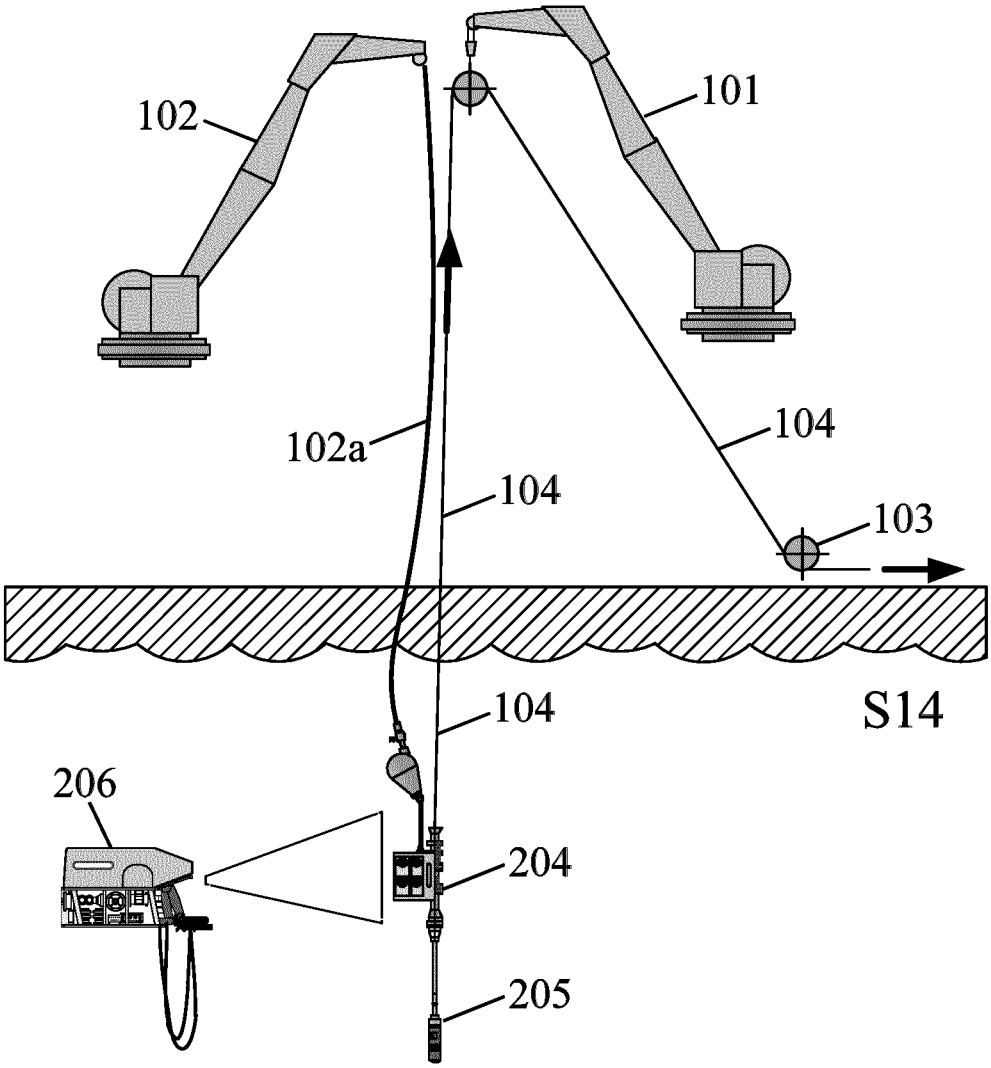

FIG. 2N illustrates a fourteenth step S14 in which the pressure control head 204 is lowered to be into contact with the tool 205, i.e. until the weight of the pressure control head 204 is taken by the wire line 104 of first crane 101 instead of the wire line 102*a* of the second crane 102. The wire line 102*a* of second crane 102 is then untighten.

This step is for example controlled by an operator at the control unit 107 looking at camera images from the ROV 206.

Figure 2O:
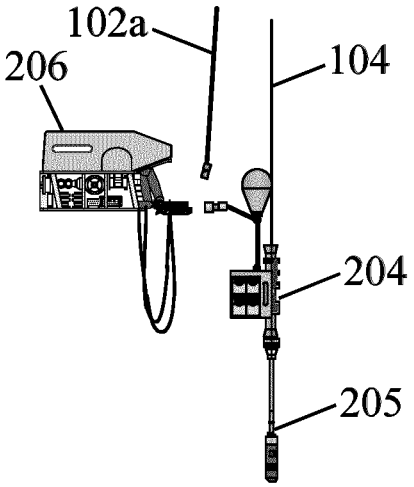

FIG. 2O illustrates a fifteenth step S15 in which ROV 206 disconnects the wire line 102*a* of second crane 102 from the pressure control head 204.

Then the assembly of the pressure control head 204 and the tool 205 is completely suspended in water bellow the wire line 104 of first crane.

This assembly is then lowered into sea water 300 down the well 200.

Figure 2P:
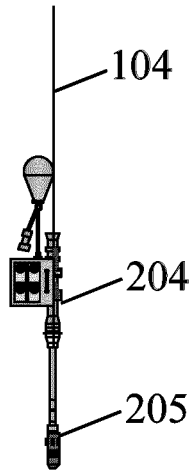
Figure 2P:
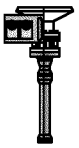

FIG. 2P illustrates a sixteenth step S16 in which said assembly reach in proximity to the upper end of the lubricator module 203 previously connected at eighth step of FIG. 2H.

Figure 2Q:
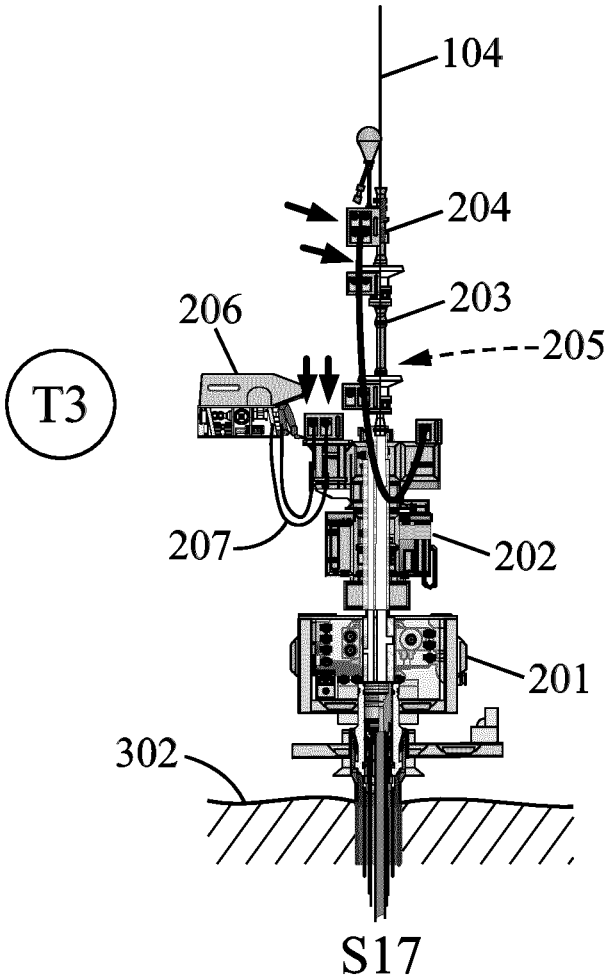

FIG. 2Q illustrates a seventeenth step S17 in which the assembly is aligned vertically to the lubricator module 203.

Then, the tool 205 is introduced inside the lubricator module 203 and the assembly is lowered until the tool 205 is fully inside the lubricator module 203, the pressure control head 204 being then landed on top of the lubricator module 203.

The ROV 206 then connects its power line 207 to the BOP module 202.

The pressure control head 204 is locked to the lubricator module 203 by control unit 107 via the ROV 106 and its power line 207.

Then, a third test T3 may be operated, said third test T3 consisting of testing the BOP module 202, the lubricator module 203 and the pressure control head 204 via the ROV 206. The third test T3 is a pressure test testing the sealing performance the main conduit between a swab valve in the subsea tree 201 and the pressure control head 204 connected above the lubricator module 203.

Then, if the third test T3 should proves sealing performance.

The ROV 206 (controlled and powered by the control unit 107) can now pressurize the main conduit between a swab valve in the subsea tree 201 and the pressure control head 204 locked above the lubricator module 203 with a fluid pressure corresponding the one in the well 200.

Then, the ROV 206 can unlock the BOP module 202, i.e. opening the main conduit valves in the BBOP module 202 to open the main conduit to the well 200.

The control unit 107 operates the first reel 103 to release the wire line 104 and to lower the tool 205 inside the well 200. The subsea well intervention can start, controlled by the control unit 107: The control unit 107 powers the lubricator module 203 and the BOP module 202 via the ROV umbilical 106, the ROV 206, and the power line 207.

Consequently, the above method comprises a test procedure including three sub-steps:

- operating a first test T1 consisting of testing the blowout preventer 202 module via the remotely operated vehicle, after connecting the blowout preventer module onto a subsea tree 201,
- operating a second test T2 of the lubricator module 203 and blowout preventer module 202 via the remotely operated vehicle, after connecting the lubricator module onto the blowout preventer module, and
- operating a third test T3 of the the pressure control head 204, the lubricator module 203 and the blowout preventer module 202, after connecting the pressure control head onto the lubricator module, the tool 205 being inside the main conduit inside the lubricator module.

Thanks to these three tests, each new connected element is tested before connecting a new one. The process is therefore safe regarding the sealing performance.

Moreover, before running down in water the assembly, the above method comprises preparing the assembly on the floating vessel by the following sub-steps:

- connecting the tool 205 to the wire line 104 from the first crane 101, vertically, above the floating vessel deck, the pressure control head 204 being above the tool 205 and the wire line 104 passing through the pressure control head toward the tool 205, and
- using the first crane 101 to move the assembly above the sea for being able to run down in water said assembly.

In such process, the assembly is prepared in suspending the pressure control head 204 and the tool 205 vertically (in a vertical direction) by manipulating them with the first crane 101 or with two cranes (the first and second cranes 101, 102).

Figure 3A:
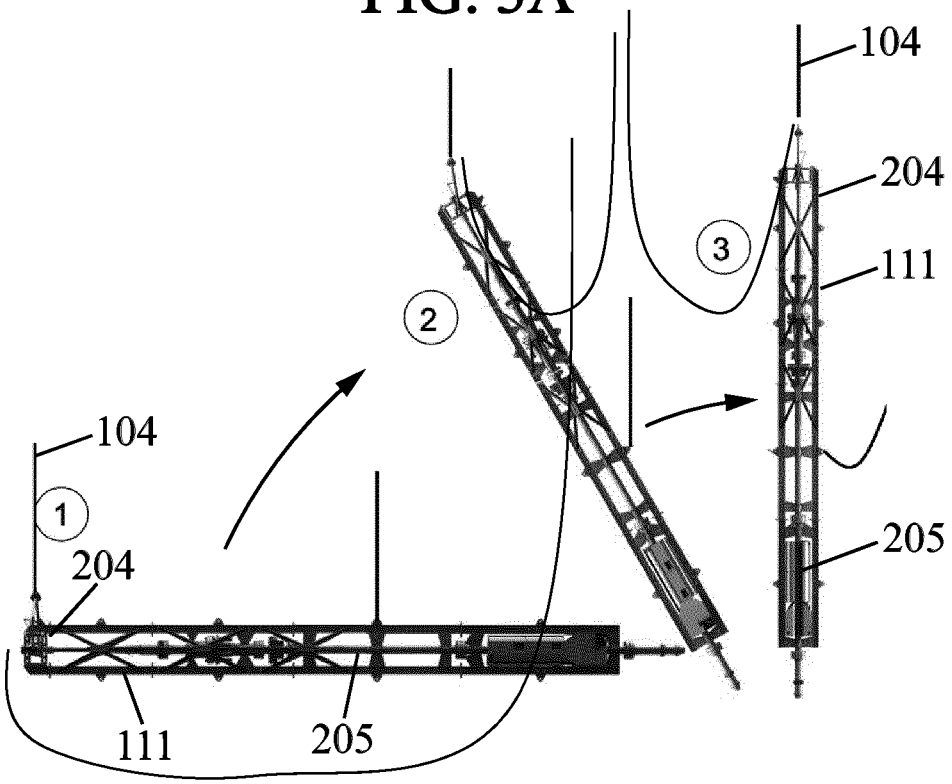
FIGS. 3A to 3B are views of preparation steps concerning a second embodiment of the method.
Figure 3B:
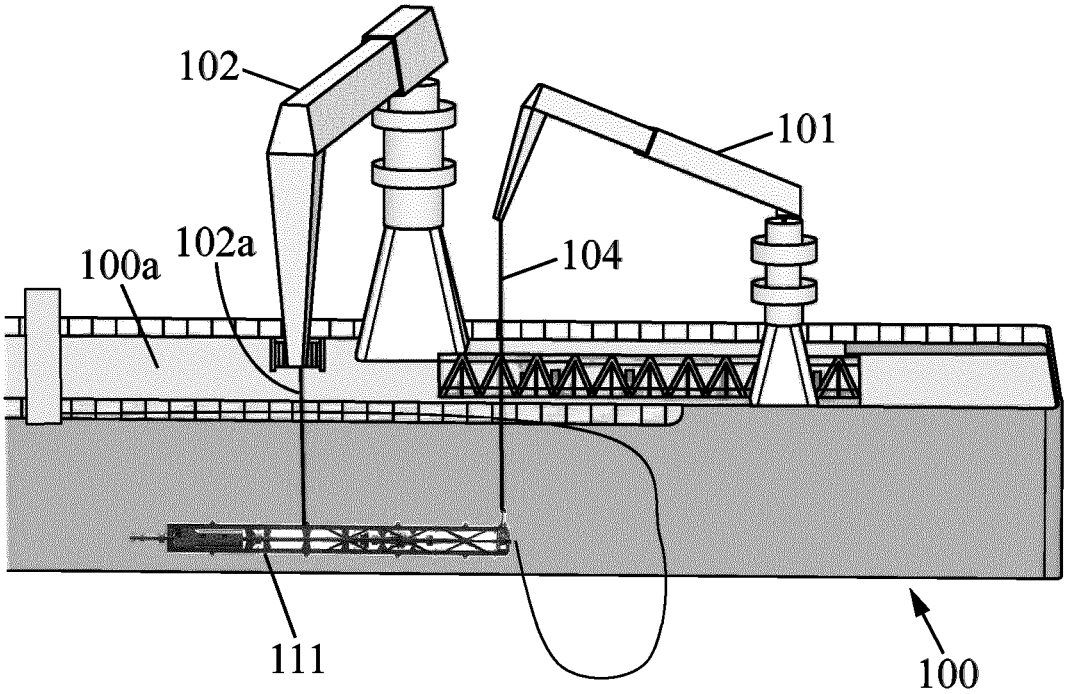

FIGS. 3A to 3B illustrate a second embodiment of the above method, wherein the assembly is prepared in a horizontal station above the floating vessel deck, contrary to the vertical direction of first embodiment. Only the steps that differ from the first embodiment will be explained. This only concern the preparation steps of FIGS. 2I to 2K that are replaced by the following preparation steps of FIGS. 3A and/or 3B.

This embodiment is adapted to lubricator module 203 and tool 205 having a great length that render the vertical preparation uncomfortable.

In this embodiment, the assembly of the pressure control head 204 and the tool 205 are positioned and maintained inside a cage or frame 111 in the horizontal direction as seen on position 1 of FIG. 3A. The pressure control head 204 and the tool 205 are secured temporally inside the cage for preventing any displacement inside the cage 111.

Then, the cage 111 containing the assembly is tilted to an inclined direction as seen on position 2 of FIG. 3A, to a vertical direction as seen on position 3 of FIG. 3A, by the use of a first crane 101 or by the use of two cranes (a first and second cranes 101, 102).

FIG. 3B illustrates an example of manipulation of the cage 111 by two cranes offboard, i.e. above the sea surface 301, for tilting the cage 111 enclosing the assembly.

Thanks to this example, a cage 111 and assembly having a wider length can be tilted to the vertical direction.

Then, according to a first variant, the assembly is free or released from the cage 111 for running together all the components of the assembly down in sea water 300 as previously explained in the first embodiment of the method (without the cage). According to a second variant, the cage 111 enclosing all the components of the assembly is run down in sea water toward the well.

Consequently, in the method of this second embodiment, before running down in water the assembly, the method comprises preparing the assembly on the floating vessel by:

- enclosing the assembly inside a cage 111 to maintain the assembly steady positioned inside said cage, said cage being located horizontally on the floating vessel deck,
- connecting the tool 205 to the wire line 104 from the first crane, the wire line passing through the pressure control head toward the tool,
- tilting the cage enclosing the assembly into a vertical direction, and
- moving the assembly above the sea for being able to run down in water said assembly.

The step of moving the assembly above the sea can be operated via one crane (the first crane 101) or by two cranes (the first and second cranes 101, 102) as it can be seen on FIG. 3B.

According to a third embodiment, similar to the second embodiment, the assembly is prepared in a horizontal station above the floating vessel deck. Only the steps that differ from the first embodiment will be explained. This concerns the steps of FIGS. 2E to 2P that are replaced by the following steps. This embodiment is not illustrated in the figures but such figures would be identical to the FIGS. 3A and 3B, except adding a numeral reference 203 in direction to inside a cage or frame 111.

Indeed, in the third embodiment, the assembly comprises the pressure control head 204 and the tool 205 as in the first and second embodiments, but also comprises the lubricator 203. The tool 205 is installed inside the lubricator 203, and the pressure control head 204 can be already connected (secured) to the lubricator 203. All these components (203, 204, 205) are temporally secured inside the cage 111 for preventing any displacement inside said cage 111, said cage 111 being in the horizontal position on the floating vessel deck.

The subsea well intervention method of this third embodiment is a little modified compared to the first and second embodiments, as the lubricator 203 is included in the assembly prepared before running into water.

Then, the subsea well intervention method still uses a floating vessel not comprising a derrick and is therefore a rigless and derrickless intervention method. This method generally comprises the following steps:

- connecting a blowout preventer module 202 onto a subsea tree 201,
- connecting a power line 207 directly between a remotely operated vehicle 206 and the blowout preventer module 202 for powering the blowout preventer module, the remotely operated vehicle 206 being connected to a control unit 107 located on the floating vessel via a remotely operated vehicle umbilical 106,
- running down in water an assembly of a lubricator module 203, a pressure control head 204 and the tool 205, the pressure control head being connected to the lubricator module, the tool being inside the lubricator module and being suspended by a wire line 104 from a first crane 101 of the floating vessel,
- connecting the lubricator module 203 of the assembly onto the blowout preventer module 202, the lubricator module including the tool,
- operating a test procedure of at least one of the pressure control head 204, the lubricator module 203 and the blowout preventer module 202 by the control unit 107 and via the remotely operated vehicle 206 and its power line 207,
- opening valves of the blowout preventer module 202, and running the tool 205 down inside the well 200.

The power line 207 from ROV 206 comprises a hydraulic line. Preferably, the power line 207 comprises a hydraulic line and an electric line.

The power line 207 is fed with the ROV umbilical 106, and it may be controlled by the ROV 206 itself by information from the control unit 107.

The assembly is prepared above the floating vessel deck.

The cage 111 containing the components of the assembly, i.e. the lubricator 203, the pressure control head 204 and the tool 205, is tilted to an inclined direction similarly as on position 2 of FIG. 3A, to a vertical direction similarly as on position 3 of FIG. 3A, by the use of a first crane 101 or by the use of two cranes (a first and second cranes 101, 102).

The manipulation of the cage 111 can be operated by two cranes offboard, above sea surface 301, for tilting the cage similarly as on FIG. 3B.

Thanks to this example, the assembly can have a wider length and can be tilted to the vertical direction. A tool having a great length can be easily and safely manipulated. Moreover, the method is simplified compared to the first embodiment and compared to the second embodiment. Such method can be implemented more quickly and is less costly.

Then, according to a first variant, the assembly is free or released from the cage 111 for running together all the components of the assembly down in sea water 300 as previously explained (without the cage). According to a second variant, the cage 111 enclosing all the components of the assembly is run down in sea water toward the well.

Consequently, in the method of this third embodiment, before running down in water the assembly, the method comprises preparing the assembly on the floating vessel by:

- enclosing the assembly inside a cage 111 to maintain the assembly steady positioned inside said cage, said cage being located horizontally on the floating vessel deck,
- connecting the tool 205 to the wire line 104 from the first crane, the wire line passing through the pressure control head toward the tool,
- tilting the cage enclosing the assembly into a vertical direction, and
- moving the assembly above the sea for being able to run down in water said assembly.

During this assembly preparation step, the pressure control head 204 is connected and secured to the lubricator module 203. This connection can be tested, for example by a pressure test performed on the floating vessel deck by various pressure tools.

During this assembly preparation step, the tool 205 is installed inside the lubricator module 203. Therefore, the wire line 204 is connected to the tool 205 inside the lubricator module 203 and this wire line 104 passes through the pressure control head 204 to the first crane 101.

The step of moving the assembly above the sea can be operated via one crane (the first crane 101) or by two cranes (the first and second cranes 101, 102) similarly as it can be seen on FIG. 3B.

Then, the assembly comprising the lubricator module 203, the pressure control head 204 and the tool 205, the pressure control head being connected to the lubricator module, the tool being inside the lubricator module and being suspended by a wire line 104 from a first crane 101 of the floating vessel, is run down in water towards the BOP module 202, Then, the lubricator module 203 of said assembly is connected onto the blowout preventer module 202, the lubricator module including the tool.

Then, the ROV 206 operates a test procedure of the pressure control head 204, the lubricator module 203 and the blowout preventer module 202 by the control unit 107 and via its power line 207. The test procedure is a pressure test to ensure sealing performance of a main conduit inside the blowout preventer module 202, the lubricator module 203 and the pressure control head 204, the tool 205 being inside the main conduit in the lubricator module. This pressure test is performed to control the sealing performance of the connection between the lubricator module 203 and the BOP module 202, before opening valves of the blowout preventer module that open the main conduit to the well, and before running the tool inside the well.

In all embodiments of the disclosed method, the control unit 107 communicates with the ROV 206 via a physical (wire) link or via a wireless link. The wire link is preferably embedded inside the ROV umbilical 106. The wireless link can be an acoustic link.

The invention claimed is:

1. A subsea well intervention method implemented on a well from a floating vessel, said floating vessel not comprising a derrick, the method comprising:

- connecting a blowout preventer module onto a subsea tree;
- connecting a lubricator module onto the blowout preventer module;
- connecting a power line directly between a remotely operated vehicle and the blowout preventer module for powering the blowout preventer module, the remotely operated vehicle being connected to a control unit located on the floating vessel via a remotely operated vehicle umbilical;
- running down in water an assembly of a tool and a pressure control head, said tool being suspended by a wire line from a first crane of the floating vessel;
- running the tool inside the lubricator module;
- connecting the pressure control head onto the lubricator module;
- operating a test procedure of at least one of the pressure control head, the lubricator module and the blowout preventer module by the control unit and via the remotely operated vehicle and its power line;
- opening valves of the blowout preventer module; and
- running the tool down inside the well.

2. The method according to claim 1, wherein the test procedure is at least a pressure test to ensure sealing performance of a main conduit inside the blowout preventer module, the lubricator module and the pressure control head, before opening valves of the blowout preventer module that open said main conduit to the well.

3. The method according to claim 1, wherein the test procedure comprises:

- operating a first test consisting of testing the blowout preventer module via the remotely operated vehicle, after connecting the blowout preventer module onto a subsea tree;
- operating a second test of the lubricator module and blowout preventer module via the remotely operated vehicle, after connecting the lubricator module onto the blowout preventer module; and
- operating a third test of the pressure control head, the lubricator module and the blowout preventer module, after connecting the pressure control head onto the lubricator module, the tool being inside a main conduit inside the lubricator module.

4. The method according to claim 1, wherein, before running down in water the assembly, the method comprises preparing the assembly on the floating vessel by:

- connecting the tool to the wire line from the first crane, vertically, above the floating vessel deck, the pressure control head being above the tool and the wire line passing through the pressure control head toward the tool; and
- using the first crane to move the assembly above the sea for being able to run down in water said assembly.

5. The method according to claim 1, wherein, before running down in water the assembly, the method comprises preparing the assembly on the floating vessel by:

enclosing the assembly inside a cage to maintain the assembly steady positioned inside said cage, said cage being located horizontally on the floating vessel deck;

connecting the tool to the wire line from the first crane, the wire line passing through the pressure control head toward the tool;

tilting the cage enclosing the assembly into a vertical direction; and moving the assembly above the sea for being able to run down in water said assembly.

6. The method according to claim 1, wherein the power line comprises a hydraulic line and an electric line.

7. The method according to claim 1, wherein the control unit communicates with the remotely operated vehicle via a physical link or via a wireless link.

8. The method according to claim 7, wherein the wireless link is an acoustic link.

9. A subsea well intervention method implemented on a well from a floating vessel, said floating vessel not comprising a derrick, the method comprising:

connecting a blowout preventer module onto a subsea tree;

connecting a power line directly between a remotely operated vehicle and the blowout preventer module for powering the blowout preventer module, the remotely operated vehicle being connected to a control unit located on the floating vessel via a remotely operated vehicle umbilical;

running down in water an assembly of a lubricator module, a pressure control head and a tool, the pressure control head being connected to the lubricator module, the tool being inside the lubricator module and being suspended by a wire line from a first crane of the floating vessel;

connecting the lubricator module of the assembly onto the blowout preventer module, the lubricator module including the tool;

operating a test procedure of at least one of the pressure control head, the lubricator module and the blowout preventer module by the control unit and via the remotely operated vehicle and its power line;

opening valves of the blowout preventer module; and running the tool down inside the well.

10. The method according to claim 9, wherein the test procedure is a pressure test to ensure sealing performance of a main conduit inside the blowout preventer module, the lubricator module and the pressure control head, the tool being inside the main conduit in the lubricator module, and said pressure test being performed before opening valves of the blowout preventer module that open said main conduit to the well.

11. The method according to claim 9, wherein, before running down in water the assembly, the method comprises preparing the assembly on the floating vessel by:

enclosing the assembly inside a cage to maintain the assembly steady positioned inside said cage, said cage being located horizontally on the floating vessel deck;

connecting the tool to the wire line from the first crane, the wire line passing through the pressure control head toward the tool;

tilting the cage enclosing the assembly into a vertical direction; and moving the assembly above the sea for being able to run down in water said assembly.

12. The method according to claim 9, wherein the power line comprises a hydraulic line and an electric line.

13. The method according to claim 9, wherein the control unit communicates with the remotely operated vehicle via a physical link or via a wireless link.

14. The method according to claim 13, wherein the wireless link is an acoustic link.

* * * * *